US009937433B2

(12) United States Patent
Stolten

(10) Patent No.: US 9,937,433 B2
(45) Date of Patent: Apr. 10, 2018

(54) TOY CONSTRUCTION SYSTEM

(76) Inventor: Mark Randall Stolten, Auckland (NZ)

( * ) Notice: Subject to any disclaimer, the term of this patent is extended or adjusted under 35 U.S.C. 154(b) by 0 days.

(21) Appl. No.: 13/994,443

(22) PCT Filed: Dec. 16, 2011

(86) PCT No.: PCT/NZ2011/000264
§ 371 (c)(1),
(2), (4) Date: Oct. 3, 2013

(87) PCT Pub. No.: WO2012/082000
PCT Pub. Date: Jun. 21, 2012

(65) Prior Publication Data

US 2014/0024283 A1 Jan. 23, 2014

(30) Foreign Application Priority Data

Dec. 16, 2010 (NZ) ..... 590000

(51) Int. Cl.
*A63H 33/04* (2006.01)
*A63H 33/10* (2006.01)
*A63H 33/08* (2006.01)
*A63H 33/12* (2006.01)

(52) U.S. Cl.
CPC ..... *A63H 33/10* (2013.01); *A63H 33/086* (2013.01); *A63H 33/101* (2013.01); *A63H 33/12* (2013.01)

(58) Field of Classification Search
CPC ..... A63H 33/04; A63H 33/12; A63H 33/046; A63H 33/102; A63H 33/103; E04B 1/3445; E04H 9/02; E04H 9/028; E04F 13/0864; Y10T 24/31; Y10T 24/314; Y10T 403/45; Y10T 403/54; Y10T 403/7147
See application file for complete search history.

(56) References Cited

U.S. PATENT DOCUMENTS 124,078 A * 2/1872 Ostrander ..... 446/85
3,224,135 A * 12/1965 Wright et al. ..... 446/95
3,242,610 A * 3/1966 Godtfred ..... A63H 33/086 446/128
4,054,393 A * 10/1977 Talleri ..... 403/174
4,170,083 A * 10/1979 Freelander et al. ..... 446/95
4,211,029 A * 7/1980 Cretin ..... 446/117
RE33,785 E * 12/1991 Hildebrandt ..... A63F 9/12 434/211
5,073,138 A * 12/1991 Klitsner et al. ..... 446/103
5,215,490 A * 6/1993 Szoradi ..... 446/115
5,310,376 A * 5/1994 Mayuzumi ..... A63H 33/04 446/107
5,527,201 A * 6/1996 Maddock ..... 446/104
(Continued)

FOREIGN PATENT DOCUMENTS

WO 2005/110571 11/2005
WO 2008/096039 8/2008

*Primary Examiner* — John E Simms, Jr.
*Assistant Examiner* — Urszula M Cegielnik
(74) *Attorney, Agent, or Firm* — Tracey S. Truitt; Armstrong Teasdale LLP

(57) ABSTRACT

A toy construction system comprising a releasably connectable tendon or tether ("tendon") to connect to at least two building blocks. The tendon being resiliently deformable and providing a range of motion for each of at least two blocks, relative to each other, in at least two Cartesian axes. The tendon having an engagement, and each block having a corresponding receiving element.

18 Claims, 8 Drawing Sheets

(56) References Cited

U.S. PATENT DOCUMENTS

| | | | | | |
|---|---|---|---|---|---|
| 5,683,283 | A * | 11/1997 | Glynn | A63H 33/10 | 446/128 |
| 5,916,006 | A * | 6/1999 | Ganson | 446/85 | |
| 5,938,498 | A * | 8/1999 | Glynn | 446/124 | |
| 6,126,506 | A * | 10/2000 | Rudy | 446/85 | |
| 6,491,563 | B1 * | 12/2002 | Bailey | 446/122 | |
| 6,561,866 | B1 * | 5/2003 | Lee | 446/90 | |
| 7,374,468 | B2 * | 5/2008 | Flodin et al. | 446/85 | |
| 2004/0253902 | A1 * | 12/2004 | Sinisi | 446/85 | |
| 2008/0040984 | A1 * | 2/2008 | Lanahan | E02B 3/04 | 52/79.9 |
| 2008/0132144 | A1 * | 6/2008 | Chernick et al. | 446/486 | |
| 2010/0056013 | A1 * | 3/2010 | Kaplan | 446/92 | |
| 2011/0151743 | A1 * | 6/2011 | Munch et al. | 446/91 | |

* cited by examiner

FIGURE 7
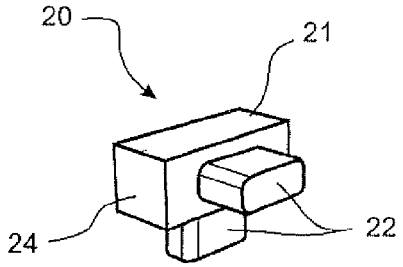
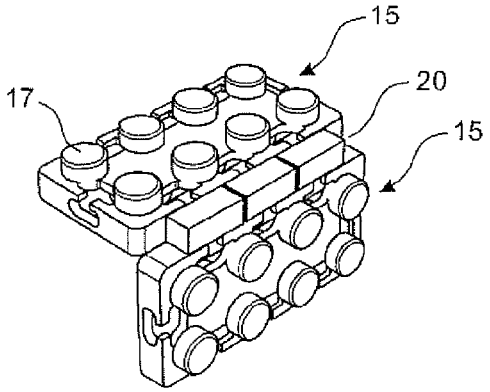
FIGURE 8A
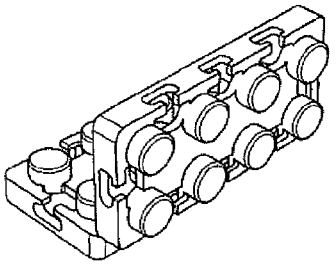
FIGURE 8B
FIGURE 9
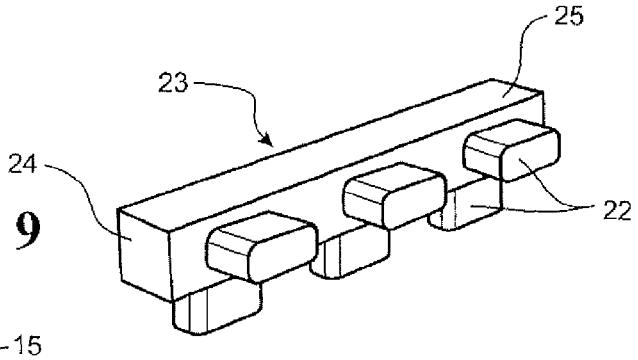
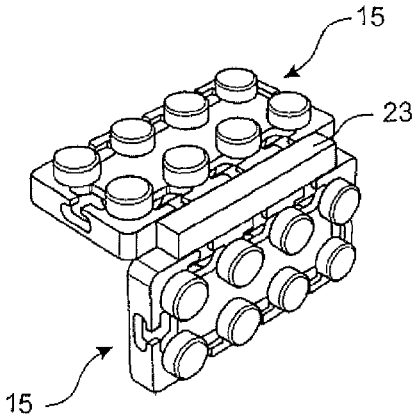
FIGURE 10A
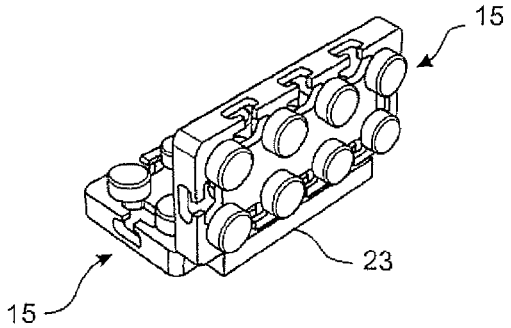
FIGURE 10B

TOY CONSTRUCTION SYSTEM

FIELD OF THE INVENTION

The present invention relates to a toy construction block system and in particular to a connection system for linking toy building blocks.

BACKGROUND TO THE INVENTION

Toy construction system known in the prior art generally include a number of building blocks that can be assembled into structures. These blocks are either assembled by simply stacking them, or are configured with a top surface having an array of projections, and a bottom surface having a similar array of recesses adapted to connect to the projections of another building block. A structure is assembled by interconnecting the top and bottom of the building blocks. However, such building blocks are limited in versatility as the structures may only be extended vertically by stacking the blocks or laterally by overlapping stacked building blocks.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

It is an object of the present invention to provide a toy construction block system which overcomes or at least ameliorates some of the abovementioned disadvantages or which at least provides the public with a useful choice.

Other objects of the invention may become apparent from the following description which is given by way of example only.

SUMMARY OF THE INVENTION

According to a first aspect the invention consists in a toy construction system comprising a releasably connectable tendon or tether ("tendon") to connect to at least two building blocks, the tendon being resiliently deformable and providing a range of motion for each at least two blocks, relative to each other, in at least two Cartesian axes, the tendon having an engagement, and each block having a corresponding receiving element.

Preferably the at least two building blocks have a plurality of projections extending upward from a top surface, and a plurality of recesses in a lower surface, the recesses shaped to frictionally engage the projections of another building block.

Preferably the tendon has a plurality of engagements.

Preferably the engagements are enlarged portions of the tendon.

Preferably the receiving element is a recess in a building block.

Preferably the plurality of engagements are located on angularly separated surfaces.

Preferably the engagements are shaped complimentary to the receiving elements, and engage by an interference fit.

Preferably the engagements are held in the receiving elements by one or more lugs.

Preferably the toy construction system further comprises a building block having at least one elongate slotted aperture, another building block having at least one aperture, and a pin to engage through an aperture on at least two building blocks to thereby facilitate a connection that is hinged about the axis of the pin and slideable about the axis of slot elongation.

Preferably the at least one aperture is located on a projection that extends from a side surface.

Preferably the at least one aperture extends from a top to a bottom surface

Preferably the pin has a head portion, and shaft portion extending downward from the head portion and a flared portion located at the base of the shaft portion.

According to a second broad aspect the invention consists in a toy construction system comprising a first building block having at least one elongate slotted aperture.

Preferably the elongation axis projects along a surface plane of the building block.

Preferably the aperture extends from a top to a bottom surface of the building block.

Preferably the toy construction system further comprises a second building block having at least one aperture.

Preferably the toy construction system further comprises a pin to engage through an aperture on each of the first and second building blocks to thereby facilitate a connection that is hinged about the axis of the pin Preferably the toy construction system further comprises a pin to engage through an aperture on each of the first and second building blocks to thereby facilitate a connection that is slideable about the axis of slot elongation.

Preferably the aperture of the second building block is located on a projection that extends from a side surface.

Preferably the pin has a head portion, and shaft portion extending downward from the head portion and a flared portion located at the base of the shaft portion.

Preferably the first, or the second, or both building blocks has a plurality of projections extending upward from a top surface, and a plurality of recesses in a lower surface, the recesses shaped to frictionally engage the projections of another building block.

Preferably the first, or the second, or both building blocks has a plurality of receiving elements.

Preferably the receiving element is a recess in a building block.

Preferably the toy construction system further comprises a releasably connectable tendon to connect to at least two building blocks, the tendon being resiliently deformable and providing a range of motion for each at least two blocks, relative to each other, in at least two Cartesian axis, the tendon having an engagement, and each block having a corresponding receiving element.

Preferably the body of the tendon has an angular portion.

Preferably the tendon has a plurality of engagements.

Preferably the engagements are enlarged portions of the tendon.

Preferably the plurality of engagements are located on angularly separated surfaces.

Preferably the engagements are shaped complimentary to the receiving element, and engage by an interference fit.

Preferably the engagements are held in the receiving elements by one or more lugs.

In another aspect the invention consists in a block having an outset profile and an inset profile whereby like blocks can be interconnected; wherein there is provided set down from the outset profile a recess to anchor a tendon or tether that is to project outwardly of the block.

Preferably the recess is defined to restrict rotation in the recess of a complementary tendon or tether.

In another aspect the invention consists in such a block together with such a tendon or tether.

In another aspect the invention consists in, in combination or assembly, a first block, a second block, the first and second blocks optionally having features whereby they can, if desired, be interconnected onto the other, and a tether engageable to each block whereby, if desired, the blocks whether separate or mutually interconnected, can be linked by the tether.

Preferably the tether is flexible.

Preferably the tether is resilient.

Preferably each of the blocks has an opening or other docking feature into which an anchorable end of the tether can be retained.

In another aspect the invention is a block suitable for such a combination or assembly.

In still another aspect the invention is a tether suitable for such a combination or assembly.

In another aspect the invention consists in a block and/or tether of any of the kinds substantially as shown in any one or more of the accompanying drawings.

The following embodiments may relate to any of the above aspects.

Other aspects of the invention may become apparent from the following description which is given by way of example only and with reference to the accompanying drawings.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

The term "comprising" as used in this specification means "consisting at least in part of". When interpreting statements in this specification which include that term, the features, prefaced by that term in each statement or claim, all need to be present but other features can also be present. Related terms such as "comprise" and "comprised" are to be interpreted in the same manner.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

The invention will now be described by way of example only and with reference to the drawings in which:

FIG. 7 shows a tendon in accordance with another embodiment of the invention.

FIGS. 8*a* and 8*b* show a plurality of tendons interconnecting a pair of building blocks.

FIG. 9 shows a tendon having a plurality of connection heads.

FIG. 10 shows the use of a tendon to interconnect a pair of building blocks.

DETAILED DESCRIPTION OF THE INVENTION

The invention relates to a toy construction system having a releasably connectable tendon to interconnect at least two building blocks. The construction system of the invention is intended to be compatible with other connectable type systems, for example the Lego or Megablock construction block systems, or non-connectable systems such as Haba block systems to thereby enhance the complexity of structures that can be assembled.

Figure 1:
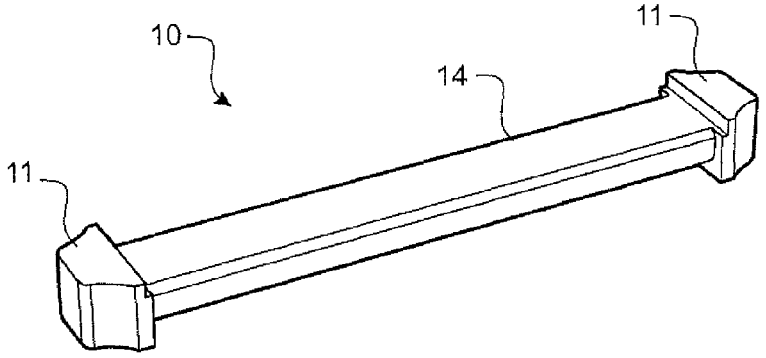
FIG. 1 shows a tendon made of a resiliently deformable material.
Figure 2:
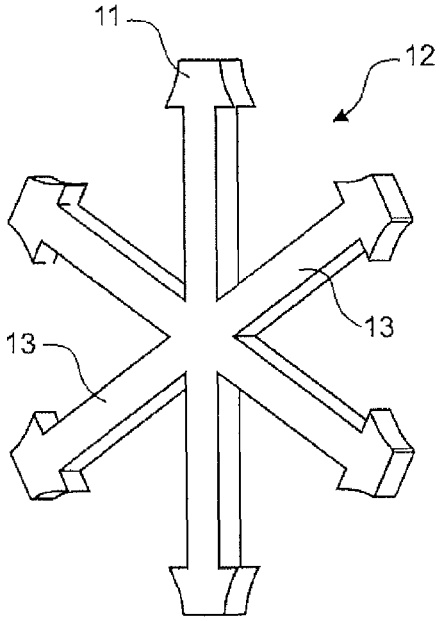
FIG. 2 shows a tendon having multiple arms.
Figure 21:
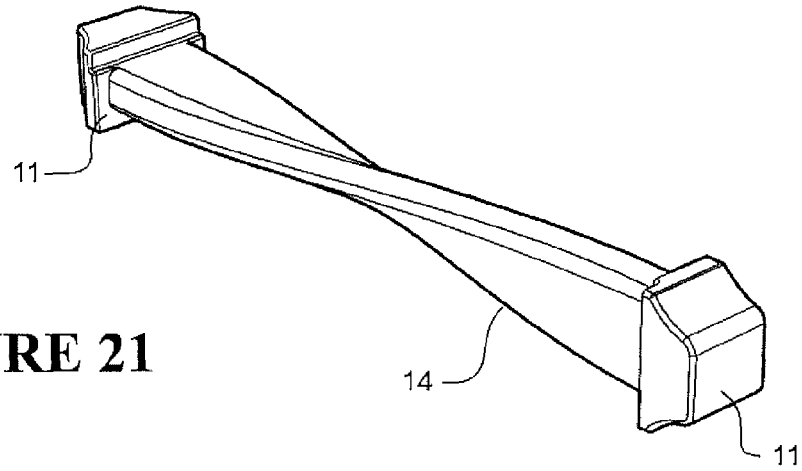
FIG. 21 shows the tendon of FIG. 1 which a moulded helical arm section.
Figure 22:
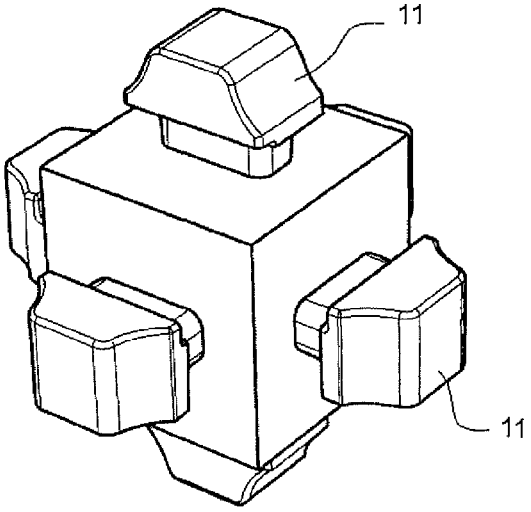
FIG. 22 shows a tendon having engagements on multiple surfaces.
Figure 23:
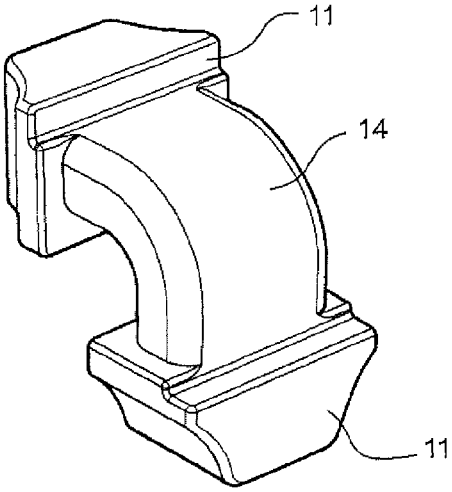
FIG. 23 shows the tendon of FIG. 1 having a moulded curved arm section.

In accordance with a first embodiment of the invention FIG. 1 shows a tether or tendon 10 that is made of a resiliently deformable material. Preferably the tendon 10 has an engagement, such as at least two connector heads 11 separated by an arm 14. Other forms of the tendon 10 may include those having a moulded tendon arm 14 having a helical section such as shown in FIG. 21, or a curved arm section 14 such as shown in FIG. 23, or some combination of twisted and curved type shapes to angularly offset the engagements 11. The tendon may also feature multiple arms 13 and engagements as shown by the tendon 12 in FIG. 2, or it may have engagements on multiple surfaces such as shown in FIG. 22.

Figure 3:
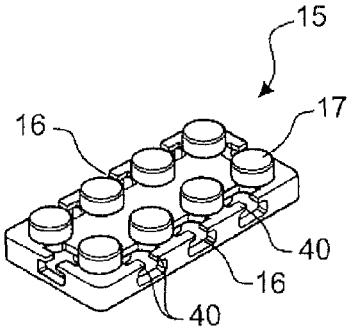
FIG. 3 shows the top side of a building block a plurality of projections from the top surface.
Figure 4:
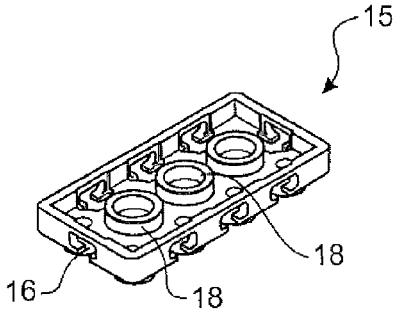
FIG. 4 shows the bottom side of the building block of FIG. 3 having a plurality of recesses adapted to receive the projections of another building block.

FIG. 3 and FIG. 4 show a building block 15 having a top surface with a plurality of projections 17 and a bottom surface having a similar array of recesses 18 adapted to receive the projections of another building block. The building block 15 also features a plurality of receiving elements interspersed below the projections 17, shown as a second plurality of recesses 16. Preferably the recesses 16 are aligned along the edges of the block 15 and are shaped to receive a connector head 11 of a tendon 10.

It should be noted the recesses 16 could be applied to a building block having any number of connecting projection 17 and recesses 18, or to a block that has no other connecting mechanism. The block may also be of any thickness or shape. Preferably where the block has projections 17 and recesses 18, they are quantised to a predefined separation pitch that enables compatibility with other building block genres.

To interconnect a plurality of building blocks 15, one head 11 of a tendon 10 is pressed into the recess 16 of a building block and another head 11 is pressed into a recess 16 of a second building block. Preferably the engagement between each connector head 11 and recess 16 is an interference fit, or at least frictional so as to provide a connection that is stable, yet releasable. The tendon 10 and building block 15 are separated by lifting the connector head 11 from the recess 16 as desired.

Alternatively, the tendon head 11 may be pressed into a recess 16 where the recess has one or more protrusions, or lugs 40 as shown in FIG. 3, that partially enclose the tendon. The tendon compresses to pass through the one or more lugs 40 and expands once it has entered the recess 16. To remove the tendon, the tendon arm portion adjacent the tendon head 11 is compressed and lifted past the lugs 40. The lugs 40 provide a stable connection that allows moderate forces to be applied to the tendon or building block, in any direction, while restraining the tendon within the recess 16.

Alternatively still, the tendon could be held in place by the placement of another building block on top. The lower surface of that block closes the opening to the recess and prevents the tendon from being withdrawn.

Figure 5A:
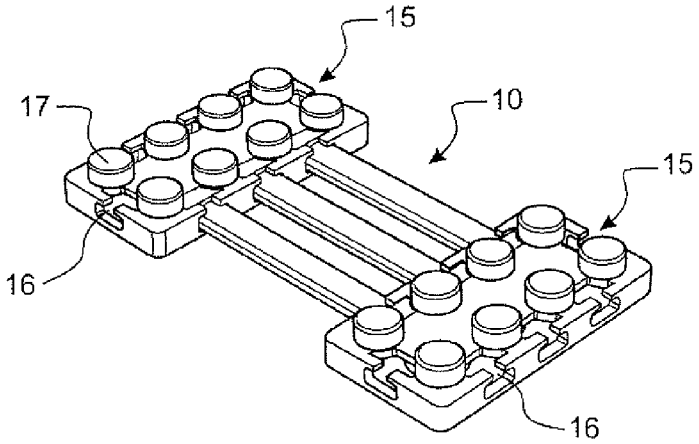
FIGS. 5*a*, 5*b* and 5*c* illustrate a pair of building blocks as shown in FIGS. 3 and 4 connected by a plurality of tendons as shown in FIG. 1.
Figure 5B:
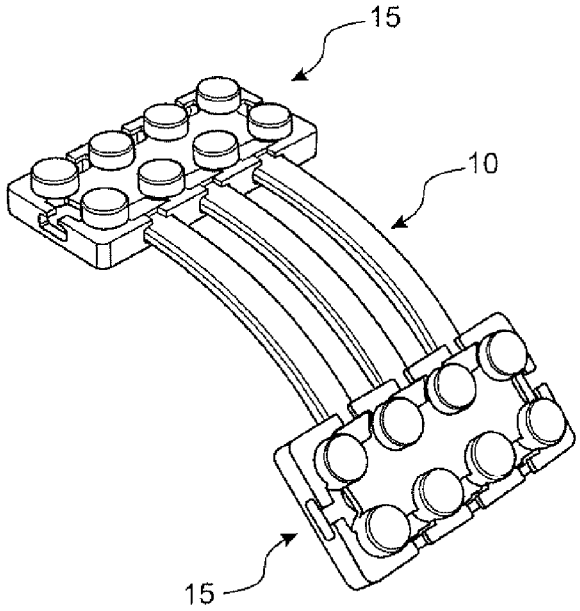
Figure 5C:
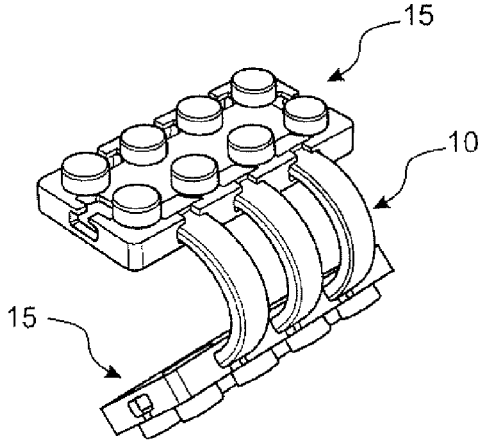

The tendon 10 provides a range of motion between building blocks 15 to which it connects. FIGS. 5*a*, 5*b* and 5*c* illustrate a pair of building blocks 15 connected by a plurality of tendons 10. The tendon 10 facilitates a range of motion between the blocks in multiple axes. For example, the blocks can be drawn away from each other by forcing the tendon to be stretched. In another example, the tendons can be twisted. In another example, the tendons can be bent. FIGS. 5*b* and 5*c* illustrate how the tendon can be deformed to change the alignment of the building blocks 15. The creation of a variable angle between interconnected building blocks allow for the planes to which the building blocks are normally aligned to deviate to a range of non-quantised alignments.

The preferred properties of tendon 10 are that it must be made of a resilient material. That is, it is deformable by force and will substantially restore to its original size, shape and orientation when it is not deformed beyond the limits of material integrity, further the material could be said to have a memory. The tendon is preferably substantially inelastic so as to avoid substantial forces that would produce pulling or pushing loads when deformed, or otherwise store significant mechanical energy. It is further preferable that deformation of the tendon does not require significant force so that deformation is easily achieved by a child. A material suitable for manufacturing the tendon includes, but is not limited to, silicone rubber.

More preferably the tendon 10 provides alignment of interconnected building blocks in at least two Cartesian axes. The tendon 10 advantageously allows for a combination of two or more of drawing, bending and twisting forces to be applied to the building blocks to angular and rotational alignments, or at least allows at least two degrees of freedom between interconnected building blocks. Two or more building blocks 15 can therefore be positioned in a variety of complex configurations by allowing building block alignment planes to be expanded, rotated, and arched or a combination thereof, or a number of other variations. When connected to two or more building blocks, the tendon therefore provides a range of motion for each of those blocks, relative to each other, in at least two Cartesian axes. However, the resilience of the tendon biases it toward its natural state when deformed.

Figure 6A:
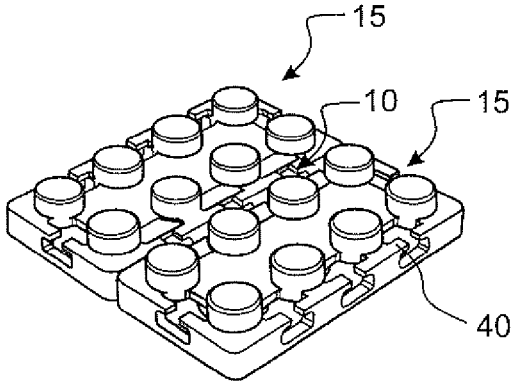
FIGS. 6*a*, 6*b* and 6*c* show a tendon interconnecting a pair of the building blocks shown in FIGS. 3 and 4.
Figure 6B:
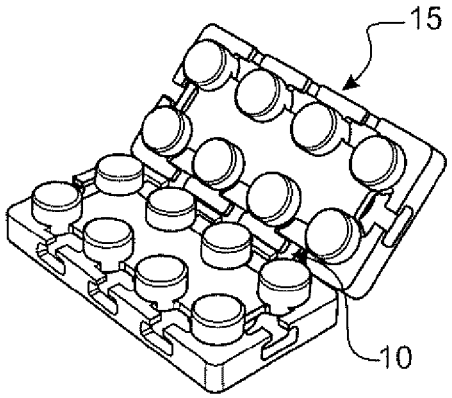
Figure 6C:
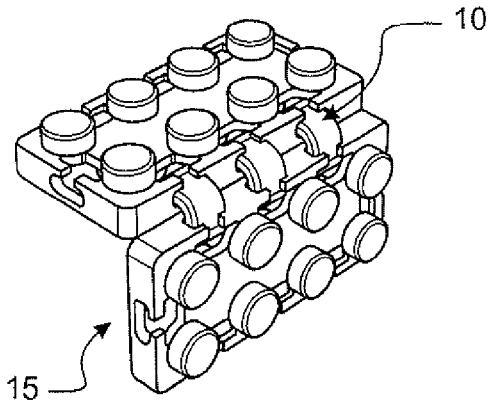

Preferably the tendon arm section 14 is of varying length, stiffness and angular shape. For example, FIGS. 6*a*, 6*b* and 6*c* show a tendon 10 interconnecting two building blocks 15 and having a short arm section. The short arm section of the tendon allows a closer positioning of adjacent building blocks while maintaining the ability to provide a variable alignment between the building blocks.

FIG. 7 shows a tendon 20 in accordance with another embodiment of the invention. The tendon 20 has a plurality of connection heads 22 and an arm section 21. As shown, the connection heads 22 may be moulded on angularly separated surfaces. However, the arm section may alternatively be moulded to include an angular portion. The particular angle between the connection heads is preferably, but not limited to, a 90 degree angle. The width of the tendon preferably corresponds to the width between protrusions 17 on the building block 15 to allow a plurality of similarly shaped tendons to be adjacently aligned.

FIGS. 8*a* and 8*b* show a plurality of tendons 20 abutted to interconnect a pair of building blocks 15. A single connection between building blocks can be facilitated, or, a plurality of tendons may be abutted about faces 24 to form many connections for additional rigidity. The building blocks are shown aligned such that tangential planes are available on which to connect further building blocks. FIG. 9 shows an alternatively shaped tendon 23 having a plurality of connection heads 22 along the arm section 25. FIGS. 10*a* and 10*b* illustrate the use of the tendon 23 to interconnect a pair of building blocks 15. Preferably the symmetry of the tendon connector head allows relative reversal of building block orientations. For example, the building blocks of FIG. 10*b* are shown to be reversed orientation to the building blocks shown in FIG. 10*b*.

Figure 11:
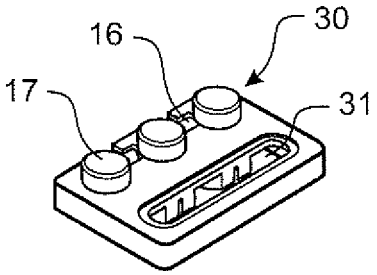
FIG. 11 shows a building block having a slotted aperture.
Figure 12:
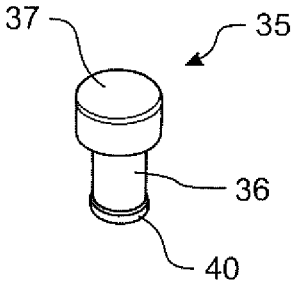
FIG. 12 shows a connecting pin for engaging the slotted aperture of the building block shown in FIG. 11.
Figure 13:
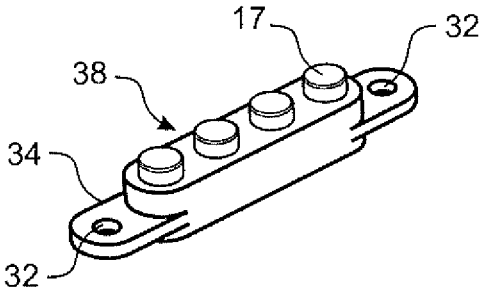
FIG. 13 shows a connecting member for use with the pin of FIG. 12 and the slotted aperture of FIG. 11.
Figure 14:
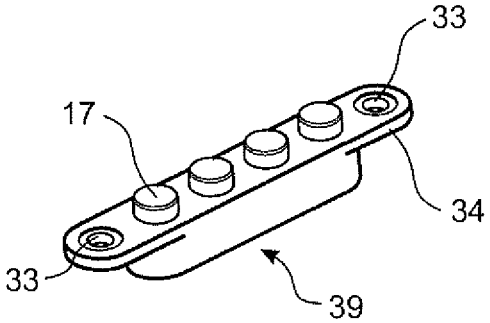
FIG. 14 shows a connecting member for use with the pin of FIG. 12 and the slotted aperture of FIG. 11.

In accordance with another embodiment of the invention a system of components is shown in FIGS. 11 to 15. FIG. 11 shows a building block 30 having a plurality of projections 17, a plurality of recesses 16 and an elongate aperture or slot 31 running a substantial length of the top surface. FIGS. 13 and 14 show elongate connecting members 38, 39 having projections 17 extending from the top surface and a tab 34 projecting from each end surface. Each tab 34 has an aperture 32, 33. A pin 35, as shown in FIG. 12, has a head portion 37, a shaft portion 36 and an enlarged portion 40 at the base of the shaft, or flare. The pin 35 acts to connect the connecting members 38, 39 to the slot 31 of the building block 30 by the insertion of the pin shaft 36 through an aperture 32, 33 and through the slot 31. Preferably the enlarged portion of the shaft 40 is marginally larger than the apertures 32, 33 and the width of slot 31 to ensure the pin can be forced through each of the openings to thereby be retained without freely disengaging.

In an alternative form, the pin may have a flared or enlarged end together with split end portion, or thin slot extending axially from the tip of the pin some way down the shaft portion 36. The split end portion allows for a slight crushing, or inward bending of the portions of the pin adjacent the split or thin slot, as the pin is forced through the slot, where the crushed portion will uncrush or unbend having passed through the slot.

In a further alternative form, the pin may be made of a resiliently deformable material. The deformable material has a flared end and bullet nosed tip for engaging with the aperture. The pin deforms as it passes through the slot and reforms to its substantially original shape having passed through the slot.

In a further alternative form, the pin may be stiff and rigid. Preferably the shaft portion of the pin 36 is narrower than the span of the slot to allow free movement. Preferably the pin engages with the aperture with an interference fit.

Figure 15A:
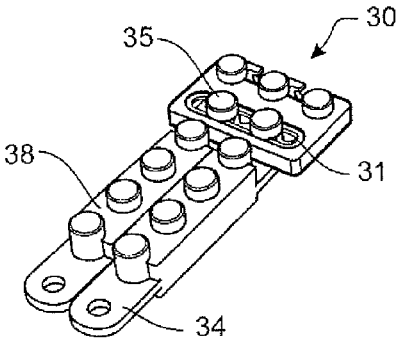
FIG. 15 shows a plurality of pins engaged with a building block and connecting members.
Figure 15B:
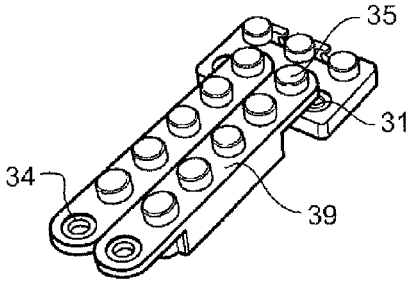

FIGS. 15*a* and 15*b* illustrate a pair of pins 35 engaged with the building block 30 and a pair of connecting members 38, 39. The pin 35 provides a slideable connection between the connecting members 38, 39 of the building block 30 by allowing lateral movement along the length of the slot 31. The pin 35 also provides a rotational coupling between the building block 30 and the connecting members 38, 39 by allowing the member to rotate about the pin axis. Preferably the tabs 34 are aligned to either an upper or a lower end of the block side 38 to facilitate a connection beneath the slot 31 as shown in FIG. 15*a*, or below the slot 31 as shown in FIG. 15*b* to allow a range of relative building block heights to be selected.

Figure 16:
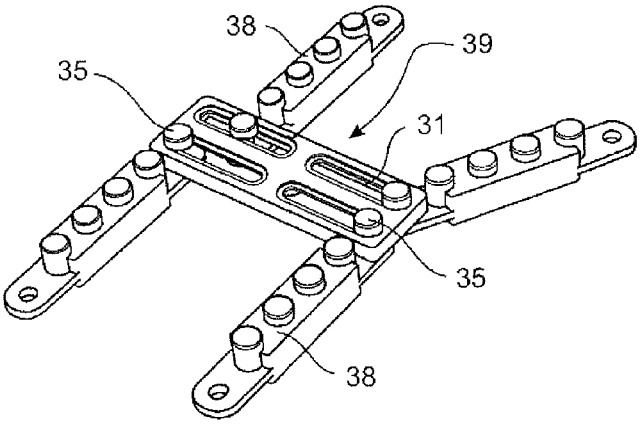
FIG. 16 shows a plurality of pins engaged with a building block and connecting members.

FIG. 16 shows a building block 39 having multiple slots 31. Each slot 31 allows for a plurality of connecting members 38 to be attached via a pin 35. Each connecting member 38 is able to pivot about the pin to allow for complex geometrical shapes, hinging mechanisms and angular connections to be formed.

Figure 17:
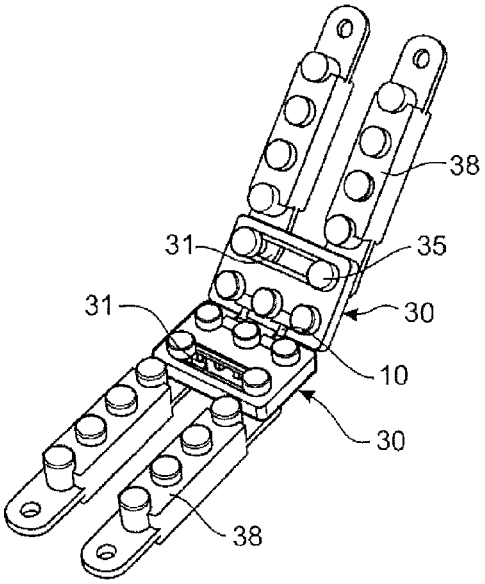
FIG. 17 shows a plurality of pins engaged with a building block, connecting members and a plurality of tendons.

FIG. 17 shows a pair of building blocks 30 linked by a pair of tendons 10. Each building block 30 has a pair of connecting members 38 attached via a pin 35 to the slot 31. The tendons 10 form a hinged connection between the building blocks 30. Each of the connecting members 38 extending from the building blocks 30 provides for the attachment of further construction blocks at a variety of angles and building planes.

Figure 18:
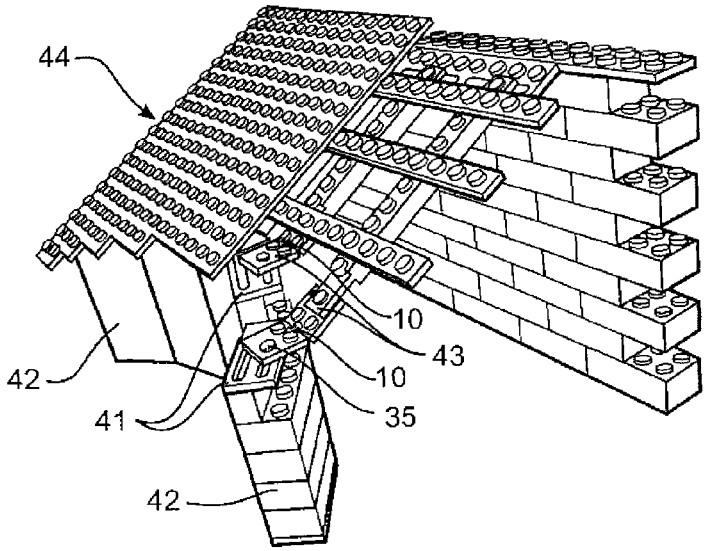
FIG. 18 shows an experimental implementation of components that illustrates possible building planes that are not constrained by conventional building block connection mechanisms.

FIG. 18 shows an experimental implementation of the described components of the invention. A house type structure is shown having walls and a roof extending from the top of the wall. The walls are aligned in a curved orientation and heightened by stacking a plurality of wall members 42. The wall members 42 are stacked by engaging a plurality of projections from a top surface of each block with a plurality of recesses in the bottom surface of each block. A slotted building block 41 is connected to the top of the wall members 42. Pins 35 engage with the slotted building block 42 and an aperture in another plurality of building blocks 43 to form a connection. The plurality of building blocks 43 are interconnected by a tendon 10 thereby allowing a non planer connection. The slotted blocks 41 pin 35, building blocks 43 and tendon 10 allow for a surface 44 to project from the wall member 43 in a direction and pitch independent from that normally dictated by the connection mechanism of the wall member 42. A structure can therefore be formed with building planes unconstrained by connection mechanism offered by the blocks 42.

Figure 19:
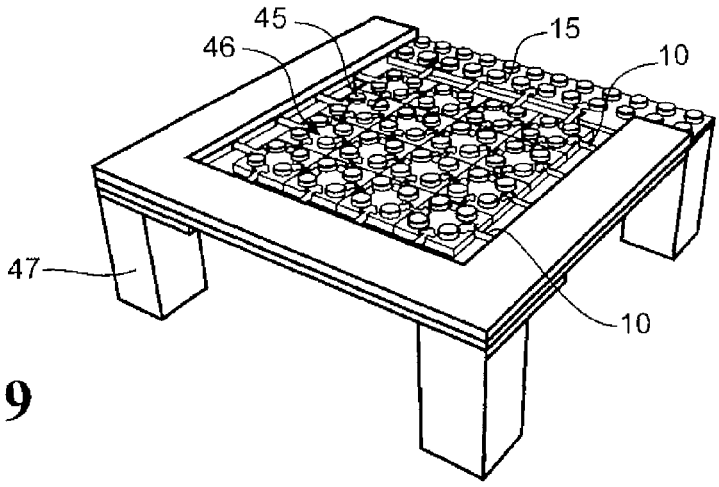
FIG. 19 shows another experimental implementation of components resembling a trampoline both in appearance and scale functionality.

FIG. 19 shows another experimental implementation of the described components of the invention. A plurality of short tendons 10 interconnect a plurality of square shaped building blocks 45 to form a surface 46. The inherent flexibility of the tendons 10 allows the surface 46 to bend and flex. The surface is suspended inside an encircling plurality of construction blocks 15 by a plurality of long tendons 10 and raised by further building blocks 47. The formed structure resembled a trampoline both in appearance and scale functionality.

Figure 20:
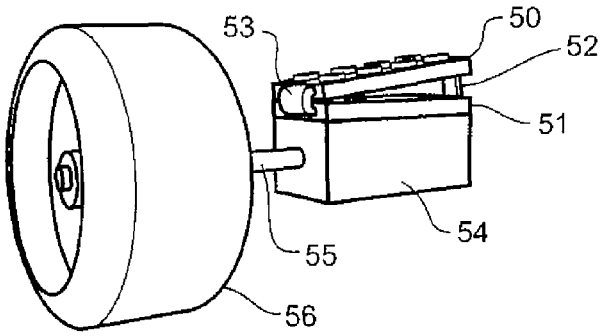
FIG. 20 shows another experimental implementation of the described components of the invention used as a suspension mechanism that lies between a vehicle body and the wheel.

FIG. 20 shows another experimental implementation of the described components of the invention. An axle carrier building block 54 is rotationally connected to an axle 55 and a wheel 56. The top of the axle carrier 54 is connected to a first block 51. A first end of a pair of tendons 52, 53 are connected at opposing ends of the first block 51. The second end of the tendons 52, 53 are connected to a second block 52 that is positioned substantially above the first block. The tendons 52, 53 align the first and second building blocks 51, 50 by being bent approximately 180 degrees. The first tendon 52 is longer than the second tendon 53 so that one end of the second building block is positioned higher than the opposing end. In this way, a vehicle body can be attached to the upper surface of the second building block 50 and the tendon 52 used as a suspension mechanism that lies between the vehicle body and the wheel 56. The suspension characteristics are provided by the resilient properties tendon.

a tendon 52 attached to one end, and the opposing end of the tendon is connected to a second building block 50. The opposing end of the first block 51 has a second tendon 53, where the opposing end of the The building blocks shown in the figures are provided as examples of possible building blocks that could be used with the described connection mechanisms. It should be appreciated that any combination of the described connection mechanisms could be combined with any of the described building blocks or other building blocks without departing from the scope of the invention.

Where in the foregoing description reference has been made to elements or integers having known equivalents, then such equivalents are included as if they were individually set forth. Although the invention has been described by way of example and with reference to particular embodiments, it is to be understood that modifications and/or improvements may be made without departing from the scope or spirit of the invention.

The invention claimed is:

1. A toy construction system, in combination or assembly, comprising:

a first block having a top and lower surface, and at least one recess to define at least one receiving element, a second block having a top and a lower surface, and a recess to define at least one receiving element, the first and second blocks having an interconnection feature for connecting to other blocks, the interconnecting feature defined by one or more interconnecting projections that extend from the top surface of a block and one or more interconnecting recesses in the lower surface, a resilient tendon comprising a deformable engagement permanently attached at each end, the engagement provided by enlarged portions of the tendon, the deformable engagement of the tendon removably captured by the receiving elements of each block whereby the first and second blocks are removably linked by the tendon that thereby allows for a combination of two or more of drawing, bending and twisting forces to be applied to the blocks to angular and rotational alignments, or at least allows two degrees of freedom between connected blocks.

2. The toy construction system as claimed in claim 1, wherein the interconnection features for interconnecting blocks are configured as a plurality of projections extending upward from a top surface of a block, and a plurality of recesses in a lower surface of a block, the recesses shaped to frictionally engage the projections of another block.

3. The toy construction system as claimed in claim 1, wherein the tendon has a plurality of deformable engagements, and wherein the deformable engagements are enlarged portions of the tendon.

4. The toy construction system as claimed in claim 3, wherein the deformable engagements are held in the receiving element by one or more lugs.

5. The toy construction system as claimed in claim 1, wherein the receiving element is a recess in a block.

6. The toy construction system as claimed in claim 1, wherein the deformable engagements are shaped complimentary to the receiving elements.

7. The toy construction system as claimed in claim 1, wherein the deformable engagements engage into the receiving elements and engage by interference fit.

8. The toy construction system as claimed in claim 1 wherein the deformable engagement is pressed into the complementary recess of the receiving element, and wherein the tendon is held in place by the placement of another block on top of the first or second block such that the resulting stacked blocks are directly connected to one another.

9. The toy construction system as claimed in claim 1, that provides for a range of motion of the blocks, relative to each other, in at least two Cartesian axes.

10. The toy construction system as claimed in claim 1, wherein at least one block has a plurality of tendons engaged with said block.

11. The toy construction system as claimed in claim 1, wherein a tendon directly connects to three or more blocks.

12. The toy construction system of claim 1, wherein the deformable engagement, in a captured state by a receiving element of the first or second block, is configured to not affect the interconnection features of the first and second blocks whereby the blocks can be interconnected to other blocks.

13. The toy construction system of claim 1, wherein the deformable engagement, in a captured state by a receiving element of the first or second block, does not protrude above a top surface of the block or below a lower surface of the block.

14. The toy construction system of claim 2, wherein the receiving elements of the first and second blocks for removably capturing deformable engagements of the resilient tendon are different from the plurality of recesses in a lower surface of a block which are shaped to frictionally engage the projections of another block.

15. The toy construction system of claim 1, wherein said first and second blocks each have a set of sidewalls connecting the top surface and lower surface of each block to thereby form said blocks, and wherein said recess defining said at least one receiving element extends through at least one of said sidewalls.

16. The toy construction system of claim 1, wherein said recess of said receiving element occupies at least a portion of the area between the top and lower surfaces of a block.

17. The toy construction system of claim 1, wherein said recess of said receiving element extends for at least a portion of the distance between the top and lower surfaces of a block.

18. The toy construction system of claim 1, wherein said recess of said receiving element is located between the top and lower surfaces of a block.

* * * * *